US006167963B1

(12) United States Patent
McMahan et al.

(10) Patent No.: US 6,167,963 B1
(45) Date of Patent: Jan. 2, 2001

(54) REMOVABLE NON-METALLIC BRIDGE PLUG OR PACKER

(75) Inventors: Michael E. McMahan, Humble; Dennis E. Kroll, League City; Yusheng Yuan, Houston, all of TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/075,036

(22) Filed: May 8, 1998

(51) Int. Cl.[7] ..... E21B 23/00; E21B 33/12

(52) U.S. Cl. ..... 166/179; 166/118; 166/134; 166/182; 277/322; 277/342

(58) Field of Search ..... 166/134, 118, 166/179, 123, 182; 277/322, 336, 342, 340

(56) References Cited

U.S. PATENT DOCUMENTS

| | | | | |
|---|---|---|---|---|
| 1,684,266 | | 9/1928 | Fisher et al. | 166/133 |
| 2,171,049 | | 8/1939 | Simmons . | |
| 2,589,506 | | 3/1952 | Morrisett | 166/128 |
| 2,647,584 | | 8/1953 | Baker et al. . | |
| 2,806,536 | * | 9/1957 | Baker et al. | 166/123 |
| 3,002,561 | * | 10/1961 | Baker et al. | 166/120 |
| 3,094,169 | * | 6/1963 | Conrad | 166/134 |
| 3,136,365 | * | 6/1964 | Carter et al. | 166/136 |
| 3,298,440 | | 1/1967 | Current . | |
| 3,343,607 | | 9/1967 | Current . | |
| 3,371,716 | | 3/1968 | Current . | |
| 3,687,196 | * | 8/1972 | Mullins | 166/217 |
| 3,749,166 | * | 7/1973 | Young | 166/123 |
| 3,799,260 | * | 3/1974 | Barrington | 166/185 |
| 3,910,348 | | 10/1975 | Pitts . | |
| 4,151,875 | * | 5/1979 | Sullaway | 166/126 |
| 4,153,108 | * | 5/1979 | Pounds et al. | 166/118 |
| 4,349,205 | * | 9/1982 | McGee et al. | 277/564 |
| 4,595,052 | * | 6/1986 | Kristiansen | 166/123 |
| 4,611,658 | * | 9/1986 | Salerni et al. | 166/134 |
| 4,708,202 | | 11/1987 | Sukup et al. | 166/122 |
| 4,730,835 | * | 3/1988 | Wilcox et al. | 277/342 |
| 4,753,444 | * | 6/1988 | Jackson et al. | 277/342 |
| 4,858,687 | | 8/1989 | Watson et al. | 166/153 |
| 5,146,994 | * | 9/1992 | Pleasants et al. | 166/387 |
| 5,224,540 | | 7/1993 | Streich et al. | 166/118 |
| 5,271,468 | | 12/1993 | Streich et al. | 166/387 |
| 5,390,737 | | 2/1995 | Jacobi et al. | 166/184 |
| 5,540,279 | | 7/1996 | Branch et al. | 166/134 |
| 5,701,959 | | 12/1997 | Hushbeck et al. | 166/387 |
| 5,857,520 | * | 1/1999 | Mullen et al. | 166/196 |
| 5,884,699 | * | 3/1999 | Mullen et al. | 166/134 |
| 5,890,537 | * | 4/1999 | Lavaure et al. | 166/285 |

OTHER PUBLICATIONS

Drawing; Baker Prime Fiberglass Packer, Prod. No. 739–09, with attached Special Products Manual Sheet (Apr. 25, 1968).

* cited by examiner

*Primary Examiner*—Eileen D. Lillis
*Assistant Examiner*—Jong-Suk Lee
(74) *Attorney, Agent, or Firm*—Duane, Morris & Heckscher LLP

(57) ABSTRACT

A composite packer or bridge plug includes substantially all nonmetallic components. The design allows the setting tool metallic components to be retrieved after the bridge plug is set. The slips contain flats with mating flats on the cones which extend to one end of the cones and guides for the slips to facilitate proper slip movement into engagement with the wellbore. A lock ring rides on the nonmetallic mandrel and secures the set, using a buttress-type thread to engage into the mandrel body. Alternative designs are revealed for backup to the sealing elements to prevent extrusion. In one design, split rings are axially compressed so that they grow in radial dimension to act as extrusion barriers. In another design, tapered scored rings are rotationally locked against each other and are axially compressed so that they bend into contact with the wellbore to act as extrusion barriers. Axial travel to obtain an extrusion barrier is minimized. The slips are made of a cohesive component and separate from each other upon advancement with respect to the cone. Mandrels of different plugs can lock together to facilitate mill-out in multi-plug installations.

27 Claims, 5 Drawing Sheets

REMOVABLE NON-METALLIC BRIDGE PLUG OR PACKER

FIELD OF THE INVENTION

The field of this invention relates to downhole packers and bridge plugs which contain principally nonmetallic components so that the packer or plug structure can be easily drilled out.

BACKGROUND OF THE INVENTION

In many applications where a packer or bridge plug is to be used, there exists a need at some point in time for subsequent removal of the plug. Packers or plugs made primarily from metallic substructures which involve resilient seals, which are compressed in a sealing relationship with the wellbore, generally take a long time to drill or mill out. Accordingly, a need has developed in the past to construct a packer of materials which are more easily drilled out than the traditional metallic structural components of packers and bridge plugs. Accordingly, bridge plugs have been made with wooden mandrels and metallic slips, as illustrated in U.S. Pat. No. 1,684,266. Other designs have featured nonmetallic mandrels and/or slips. These designs are illustrated in U.S. Pat. Nos. 5,224,540; 5,390,737; 5,540,279; 5,271,468; and 5,701,959. Other designs have simply featured softer materials or other design components so as to make the overall packer or bridge plug easy to drill out. These packers include those disclosed in U.S. Pat. Nos. 2,589,506; 4,151,875; and 4,708,202. Additionally, wiper plugs used primarily in cementing have been made of nonmetallic materials to facilitate rapid drill-out. An example of a nonrotating plug of this nature is illustrated in U.S. Pat. No. 4,858,687.

When trying to use as few metallic components as possible in a packer or bridge plug, problems develop which are not normally dealt with when constructing a mostly metallic packer. One of the difficulties is the mechanism to hold the set once the packer or bridge plug is set. Accordingly, one of the objectives of the present invention is to simplify the locking mechanism for a packer or bridge plug having primarily nonmetallic components. Another problem with composite bridge plugs or packers is to guard against extrusion of the sealing element using as few components as possible, yet providing sufficient structural strength on either side of the element to retain it in proper set position without significant extrusion due to pressure differential. Accordingly, another object of the present invention is to provide a simple, functional design which will minimize relative axial travel required to make functional the backup assemblies that retain the sealing element against extrusion. Guiding systems for slips are an important feature in a composite packer, and one of the objectives of the present invention is to provide an improved system for guiding the slips from the retracted to the set position. Composite packers will still be run into the well on a setting tool which is metallic. One of the objectives of the present invention is to provide a design which removes the components of the setting tool left behind in prior designs as a result of setting a composite packer. Thus, the objective is to retrieve metallic components of the setting tool after the set, so that subsequent milling will not be lengthened by having to mill through the residual component of the setting tool after the packer or bridge plug is set.

In another objective of the present invention, each of the composite plugs has a clutching feature or an extending tab on at least one of the top and bottom. Thus, when there are multiple composite bridge plugs set in the wellbore and they need to be drilled out, they can be pushed against one another to interlock to facilitate the milling of the top most packer or bridge plug while it is held to a lower plug which is still set. These and other features will become apparent to those of skill in the art from a description of the preferred embodiment below.

SUMMARY OF THE INVENTION

A composite packer or bridge plug is disclosed. The design features substantially all nonmetallic components. The design allows the setting tool metallic components to be retrieved after the bridge plug is set. The slips contain flats with mating flats on the cones which extend to one end of the cones and guides for the slips to facilitate proper slip movement into engagement with the wellbore. A lock ring rides on the nonmetallic mandrel and secures the set, using a buttress-type thread to engage into the mandrel body. Alternative designs are revealed for backup to the sealing elements to prevent extrusion. In one design, split rings are axially compressed so that they grow in radial dimension to act as extrusion barriers. In another design, tapered scored rings are rotationally locked against each other and are axially compressed so that they bend into contact with the wellbore to act as extrusion barriers. Axial travel to obtain an extrusion barrier is minimized. The slips are made of a cohesive component and separate from each other upon advancement with respect to the cone. Mandrels of different plugs can lock together end-to-end to facilitate mill-out in multi-plug installations.

DETAILED DESCRIPTION OF THE PREFERRED EMBODIMENT

Figure 1A:
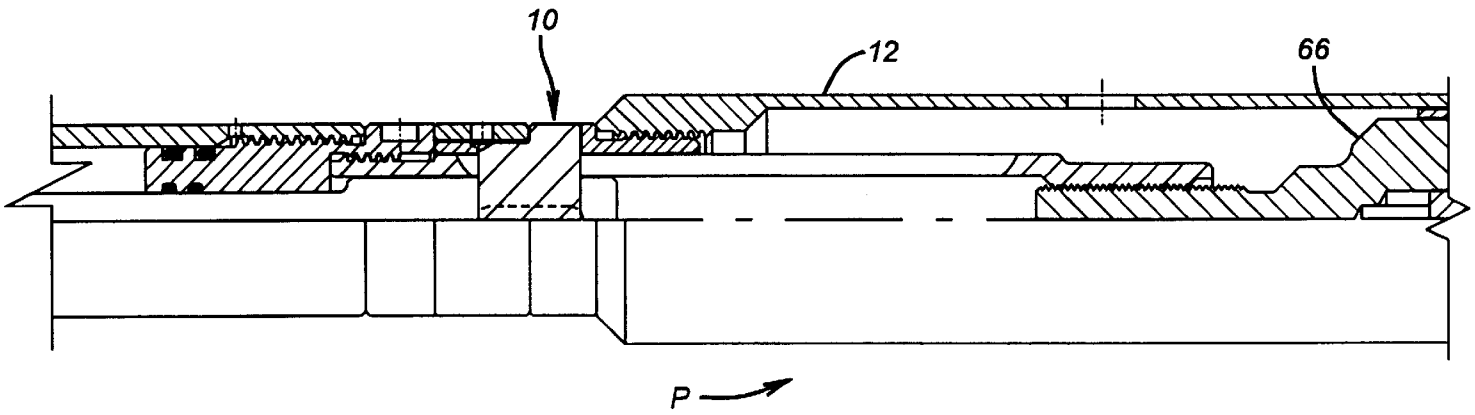
FIGS. 1*a–c* illustrate the preferred embodiment of the composite packer of the present invention.
Figure 1B:
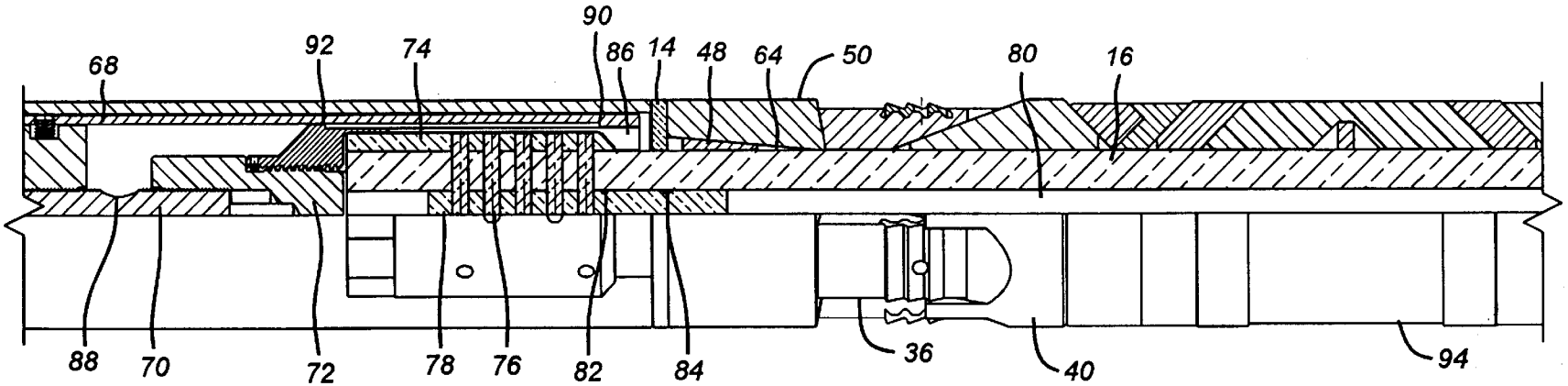
Figure 3:
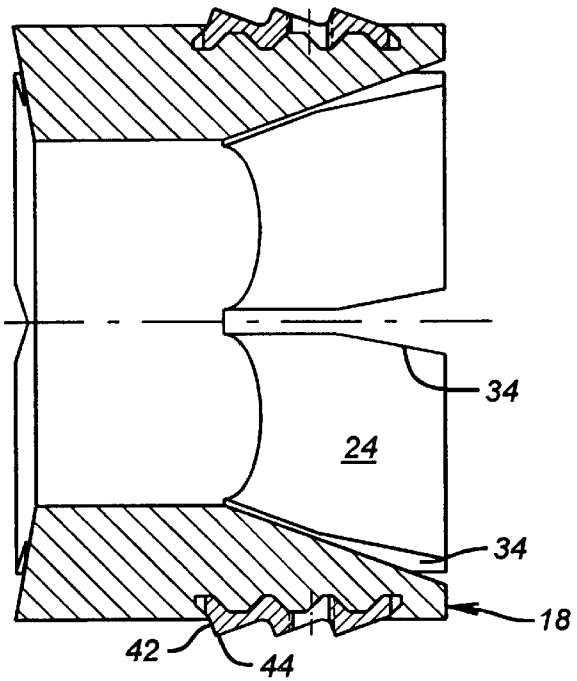
FIG. 3 is a section view through the slip assembly showing all the slips retained to each other.
Figure 1C:
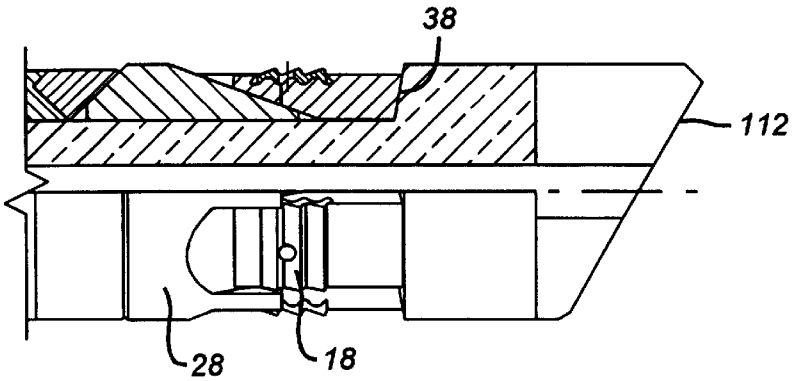
Figure 2:
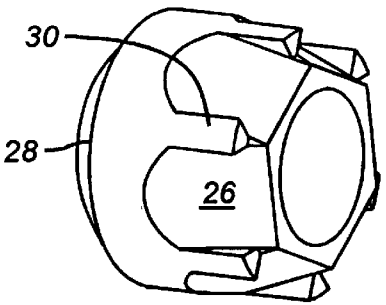
FIG. 2 is a perspective view of the cone which guides the slips.
Figure 4:
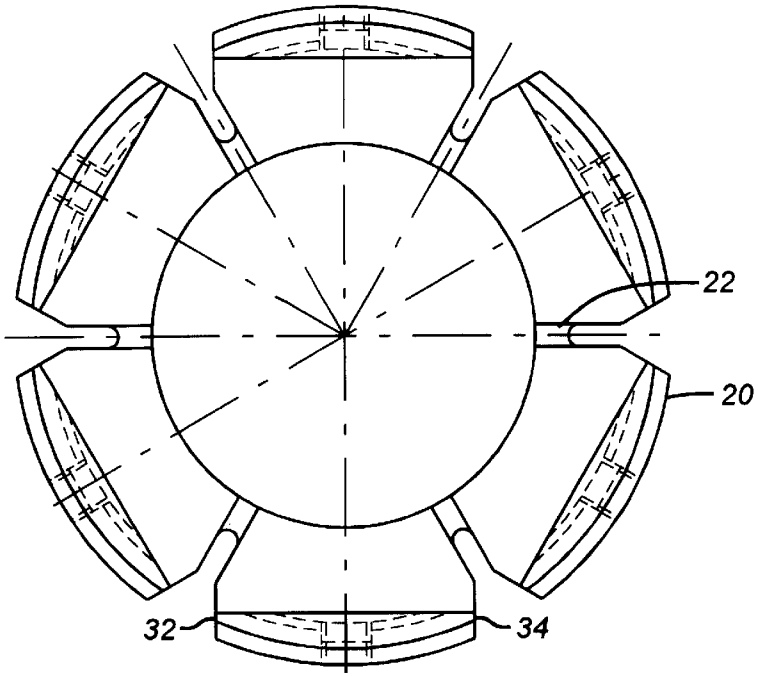
FIG. 4 is a view of FIG. 3 showing the slip ring in an end view.

The packer or bridge plug, which will be referred to as plug P, is shown in the assembly drawing of FIGS. 1*a–c*, a known setting tool 10 which can be a metallic structure. The setting tool 10 has a setting sleeve 12 which bears down on spacer washer 14. Spacer washer 14 is preferably made of a fiber glass/epoxy laminate. Mandrel 16, which is preferably made of fabric laminated fiber glass or filament wound with high-temperature epoxy resin, supports the slip molding 18. Slip molding 18 is made preferably of glass-reinforced phenolic moulding compound such as Fiberite® FM 8130E. The slip molding 18 is shown in more detail in FIGS. 3 and 4. As can be seen in FIGS. 3 and 4, the slip molding 18 is a unitary ring featuring individual slips 20 held together by tabs 22. Each of the slips 20 has a flat portion 24 which rides on a flat 26 of the cone 28 shown in FIG. 2. Cone 28 has a plurality of guides 30 which guide edges such as 32 and 34, as shown in FIG. 3 and is made from filament-wound or fabric-laminated epoxy. Referring to FIGS. 1*b* and 1*c*, slip molding 18 is in the lower position while slip molding 36 is oppositely oriented in the upper position. The mandrel 16 has a shoulder 38 which supports the slip molding 18. Cone 28 is shown in the lower position adjacent slip molding 18, while cone 40 is in the upper position adjacent slip molding 36. The cones 28 and 40 are identical but mounted in opposite directions. Slip moldings 18 and 36 are also identical but mounted in opposite directions.

Referring now to FIG. 3, the slip molding 18 and slip molding 36 each contain inserts 42 which preferably are of a serrated design, as shown in FIG. 3, and made of a hard carbon steel. Alternative metallics or nonmetallics can be inserted as the insert 42 without departing from the spirit of the invention. Each insert 42 which appears on each slip 20 has serrations 44 to help with getting a bite into the casing when the plug P is set. Those of skill in the art will appreciate that the tabs 22, shown in FIG. 4, will all break as the slip molding 18 or 36 is advanced on its respective cone 28 or 40 because the slips 20 will move away from each other and radially outwardly as they are ramped with flats 24 sliding on flats 26. By making the slip molding 18 in a single piece, it is easier to produce. Additionally, the design is preferred to using individual slips and holding them in position with a band spring as in the prior art. The use of tabs such as 22 fixes the position of all the slips to each other, plus facilitates assembly of the plug P for run in.

Figure 5:
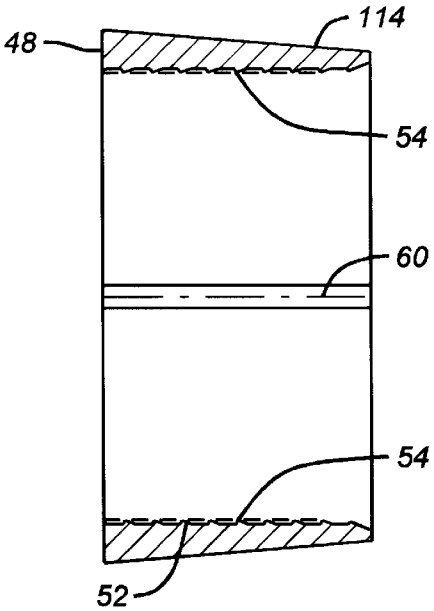
FIG. 5 is section view through the lock ring.
Figure 6:
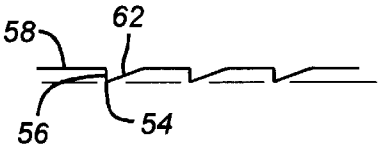
FIG. 6 is a detail of the engaging thread on the lock ring which engages the mandrel.

Referring again to FIGS. 1*a–c*, a lock ring 48, which is made preferably of aluminum with a maximum yield strength of 35,000 psi, is retained by sleeve 50, which can be of the same material as the lock ring 48 or a nonmetallic component, such as the material used for mandrel 16. The unique features of the lock ring 48 and its interaction with the mandrel 16 can be better seen by an examination of FIGS. 5 and 6. The lock ring 48 is longitudinally split and has an internal serration, preferably in the form of a buttress thread 52. It is preferred that the pitch be fairly long in the order of at least about eight threads per inch. The profile of the thread which is machined into the ring is shown in FIG. 6. It is further preferred that the relaxed diameter of the split lock ring 48 internally, as represented by the dimension between opposing ridges 54, be somewhat smaller than the diameter of the mandrel 16 on which the lock ring 48 is assembled so that a preload of stress of about 200–500 psi is seen by the lock ring 48 in its installed position within sleeve 50 upon assembly. The details of the buttress thread 52 can be seen in FIG. 6. Extending from ridge 54 is preferably a surface 56 which is preferably perpendicular to surface 58. Surface 58 is parallel to the longitudinal axis 60. Surface 62 is sloped preferably at about 20°. Ridge point 54 is defined by surfaces 56 and 62, respectively, and the length of surface 56 is the depth of the ridge 54, which indicates the maximum penetration of ridge 54 into the mandrel 16 when the plug P is set. The preferred length of surface 56 is in the order of about 0.015–0.020" for a plug to fit through a 3½" O.D. opening.

Referring to FIG. 1*b*, it can be seen that the serration or thread 52 rides on a smooth surface 64 of mandrel 16 and penetrates surface 64 to hold the set.

Referring again to the setting tool 10, there is an upper tension mandrel 66 to which is connected a tension mandrel sleeve 68. A release stud 70 connects the upper tension mandrel 66 to the lower tension mandrel 72. An upper sleeve 74 is secured to mandrel 16. Upper sleeve 74 is preferably made of fabric-laminated fiberglass with high-temperature epoxy or filament-wound fiberglass with high-temperature epoxy. It is secured to the mandrel 16 by high-temperature adhesive and shear pins 76 which are preferably fiberglass rod. The same pins that hold the upper sleeve 74 also retain the plug 78 to seal off bore 80 in mandrel 16. Plug 78 can be blown clear by breaking pins 76 to equalize plug P before it is milled out. Alternatively, plug 78 can simply be drilled out to equalize the plug P. Plug 78 is preferably made of carbon-filled PEEK or other reinforced composite materials and is secured within bore 80 of mandrel 16 in a sealing relationship due to rings 82 and 84. Connected to lower tension mandrel 72 are collet fingers 86 which are trapped by tension mandrel sleeve 68 in the position shown in FIG. 1*b*. Thus, the lower tension mandrel 72 is held to the upper sleeve 74 when the collets 86 are trapped to the upper sleeve 74. The collets 86 are released from sleeve 74 to allow retrieval of the setting tool 10. When the setting tool 10 operates, a tensile force is exerted on release stud 70, causing it to shear at the necked down portion 88. At the same time, the setting sleeve 12 bears down on spacer washer 14, with a net result of setting the packer due to relative movement. In the course of this operation, the release stud 70 breaks to allow the setting tool 10 to be retrieved. Upward movement on the setting tool 10 allows shoulder 90 on tension mandrel sleeve 68 to engage shoulder 92 on lower tension mandrel 72 so as to retrieve the lower tension mandrel 72 and that portion of the release stud 70 which is affixed to it. Accordingly, one of the advantages of the present invention is that the metallic portions of the setting tool are retrieved from above the plug P when the setting tool 10 is removed after set, as opposed to prior art designs which left metallic components of the setting tool above the nonmetallic packer or plug as a result of setting such a device.

Figure 9:
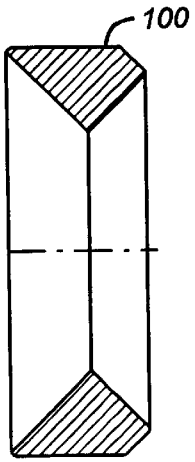
FIGS. 7, 8 and 9 are section views of an assembly of rings which act as backup and deter extrusion of the sealing element with the ring of FIG. 7 being closest to the sealing element, FIG. 8 between FIGS. 7 and 9 when fully assembled, as shown in FIG. 1*b*.
Figure 11:
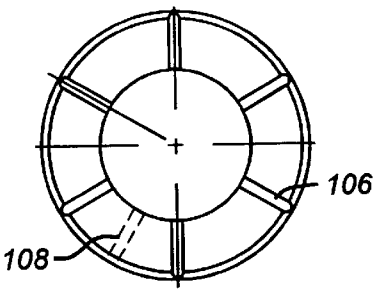
FIGS. 10 and 11 are, respectively, section and end views of an alternative embodiment which is preferred for the sealing element backup assembly showing slotted beveled rings being used.
Figure 8:
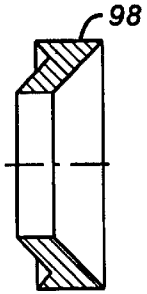
Figure 7:
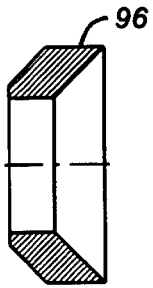
Figure 10:
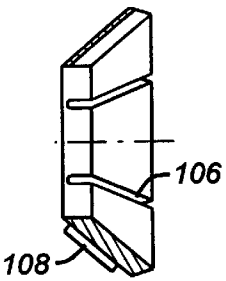
Figure 12:
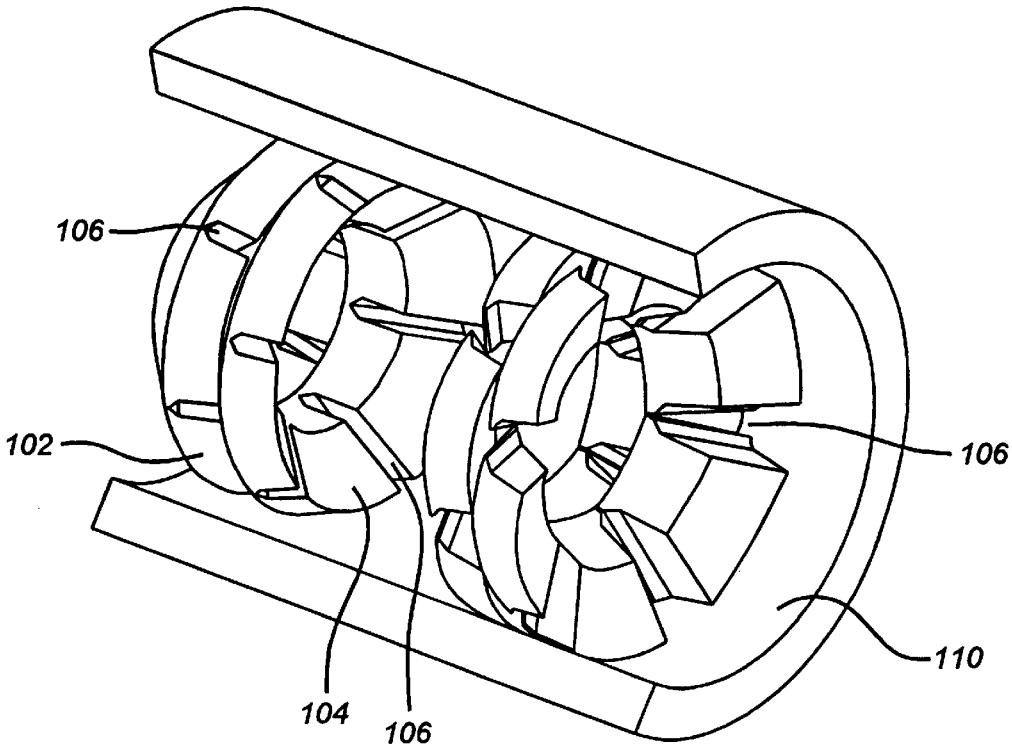
FIG. 12 shows in two different positions the overlapping rings which are scored and rotationally locked in the run-in position and the set position.
Figure 13:
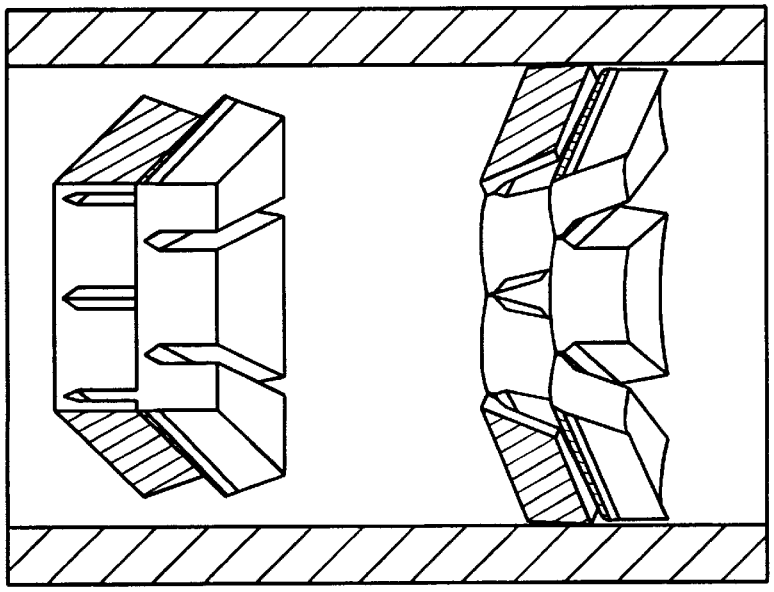
FIG. 13 is the view of FIG. 12 looking at a side view.

Referring now to FIGS. 1*b* and *c*, a sealing element 94 is shown retained by an anti-extrusion assembly comprising a beveled packing element retainer ring 96, which is seen in greater detail in FIG. 7. It is a complete ring and preferably has no longitudinal split. Stacked behind the retainer ring 96, which is preferably made of a phenolic composite material called Resinoid 1382, is a packing ring 98, as seen in FIG. 8. This ring is longitudinally split and is shaped to accept in a nested manner the cone ring 100, which is shown in FIG. 9. The packing ring 98 and cone ring 100 are preferably made of Amodel 1001 HS, a high-performance thermoplastic material. The longitudinal splits in the packing ring 98 and cone ring 100 are offset. Accordingly, when there is relative longitudinal compression, such as when the setting tool 10 is actuated, spacer washer 14 moves closer to shoulder 38. This longitudinal compression radially expands packing ring 98 and cone ring 100 so as to allow them to reach the casing and guard against extrusion of the element 94. The sealing element 94 has similar assemblies above and below, as illustrated in FIGS. 1*b* and 1*c*. In an alternative and preferred design of an anti-extrusion assembly illustrated in FIGS. 10–13, the assembly of rings 96, 98, and 100 are replaced with a plurality of overlapping beveled rings such as 102 and 104, shown in FIG. 12. These rings 102 and 104 are slotted radially, with a plurality of spaced-apart slots 106, which are also shown in FIG. 10. On the other side of each of the rings and spaced between the slots 106 are tabs 108, also best seen in FIGS. 10 and 11. It can be seen that the tabs 108 of one ring extend into the slots 106 of the adjacent ring such that the slots are offset in the run-in position shown on the left-hand side of FIG. 12. The extension of the tabs 108 into the slots 106 prevents relative rotation between rings such as 102 and 104. As shown in the right-hand side of FIG. 12, when exposed to axial compression, the slots 106 spread apart as the beveled rings are moved toward a flattened position so that the outside diameter of each of the rings grows until it makes contact with the tubing or casing 110. The same effect is shown in a side view in FIG. 13. Two or more rings such as 102 and 104 can be used without departing from the spirit of the invention. The operation of rings 102 and 104 is distinctly different from the assembly of rings 96, 98, and 100 described and shown in FIGS. 7, 8, and 9. In the design employing the rings 96, 98, and 100, a greater degree of axial travel is necessary to open up the longitudinal splits in rings 98 and 100 sufficiently far to encounter the tubing or casing 110. On the other hand, using two or more of the slotted rings, such as 102 or 104, S allows such rings to contact the tubing or casing 110 with a far lesser amount of axial relative movement during the setting process. This occurs because the rings 102 and 104 are actually bent toward a flattened position due to relative axial movement by an angular bending which opens up the slots 106, as shown in FIGS. 12 and 13 in the right-hand portion. Thus, the bending in rings 102 and 104 occurs about the center of the rings and down toward a plane perpendicular to the centerline of those rings, as opposed to the rings 98 and 100 which must be spread radially until contact with the casing or tubing 110. In many situations with available running tools or setting tools 10, the amount of relative axial movement is limited, thus creating a distinct advantage for the anti-extrusion back-up system illustrated by using the radially slotted rings such as 102 and 104.

In another feature of the present invention, the plug P has at least one of top and bottom end clutching feature which is shown in FIG. 1*c*, for example, at the bottom of the plug P as item 112. In an installation involving multiple packers or plugs P, they can be pushed one against the other and interlocked due to the conforming mating shapes which prevent relative rotation. Thus, one plug P which has been released can fall and be engaged by the next lower plug P in a manner where no relative rotation can occur to facilitate the further milling of the plug P in the wellbore. The clutching or nonrotation feature can be accomplished in a variety of ways, including matching slanted tapers or other types of lug arrangements.

Those skilled in the art will now appreciate that there are several advantages to the plug P as described above. One of the features is the ability to engage the remaining portions of the setting tool 10 below the tensile failure so that they can be retrieved after the plug P is set. By actuation of the setting tool 10, the mandrel 16 is brought up with respect to the spacer washer 14 and the lock ring 48 holds the set position between the mandrel 16 and the sleeve 50. The outer sloping surface 114 (see FIG. 5) of the lock ring 48 engages a mating sloping surface internally on sleeve 50 to further assist the ridge 54 of the buttress thread 52 to dig into the smooth surface 64 of mandrel 16. Thus, the locking device is simple in its operation and is easily drilled out, being made of a relatively soft aluminum material which can interact with the smooth surface 64 of the mandrel 16 to hold the set of the plug P. At the same time, the removal of the setting tool 10 entails the recapture of the severed component parts so that subsequent milling out of the plug P is facilitated by the absence of durable metallic parts left over from the setting operation. The alternative designs which have been depicted for extrusion resistance of the element 94 allow expansion so that rings 98 and 100 extend fully against the casing or tubular 110. In the alternative preferred embodiment, using the beveled rings with radial slots 106, the feature of full bore protection against extrusion is accomplished with far less relative longitudinal movement than it takes to set the rings 98 and 100 against the tubing or casing 110.

The interaction between the individual slips 20 and the flat surface 26 on the cone 28, for example, allows a greater flexibility in manufacturing of the slip molding 18 and a broader versatility in size ranges as the slips 20 can cover a greater extension due to the interaction of the flat surface 24 on the slips 20 with the corresponding surface 26 on the cone such as 28. The design is to be contrasted with cones of prior designs where the flat segments on the cones come to a point whereas in cone 28, for example, the flat segments 26 are cut clean to the end, assuring a more uniform contact with each of the slips 20 and the tubing or casing 110. Depending on the downhole environment, the slip molding 18 can be made from Fiberite FM 8130 or 5083, or E7302 Resinoid 1382X. Finally, the clutching feature, in a multiple installation, allows taking advantage of the fact that the lowermost plugs P are still fixed to ease in the milling of those plugs P which are above due to the ability of one plug P to interconnect with an adjacent plug in a manner preventing relative rotation.

The foregoing disclosure and description of the invention are illustrative and explanatory thereof, and various changes in the size, shape and materials, as well as in the details of the illustrated construction, may be made without departing from the spirit of the invention.

What is claimed:

1. In combination, a substantially nonmetallic packer or bridge plug for a downhole tubular, comprising:

a nonmetallic mandrel having an outer surface;

a sealing element;

at least one slip movable on at least one cone between a retracted and a set position;

a locking member to hold said slip in said set position with said sealing element compressed against the tubular;

said locking member comprises a gripping surface which slides with respect to said mandrel in a first direction as said slip is set and said sealing element is compressed, and subsequently penetrates said outer surface of said mandrel to hold said slip in the set position and said sealing element in the compressed position.

2. The packer or bridge plug of claim 1, wherein:

said mandrel outer surface is smooth adjacent said locking member.

3. The packer or bridge plug of claim 2, wherein:

said locking member comprises a ring shape with an internal serration to penetrate said smooth surface.

4. The packer or bridge plug of claim 3, wherein:

said serration comprises a buttress-type thread.

5. The packer or bridge plug of claim 4, wherein:

said ring shape is longitudinally split and is dimensioned so as to initially fit over said smooth surface with a residual stress applied by said ring shape to said mandrel.

6. The packer or bridge plug of claim 4, wherein:

said thread has a pitch of at least about 8 threads per inch.

7. The packer or bridge plug of claim 4, wherein:

said thread defines at least one ridge, said ridge having a height and is defined by a surface substantially perpendicular to a longitudinal axis of said ring shape and a sloping surface with respect to said longitudinal axis;

said ridge embedding into said mandrel for a lock of said slip and said sealing element.

8. The packer or bridge plug of claim 7, wherein:

said perpendicular surface defining the height of said ridge is less than about 0.020 inches.

9. The packer or bridge plug of claim 3, wherein:

said ring shape has an exterior taper which engages an internal taper of a surrounding sleeve to wedge said serration into said mandrel.

10. In combination, a substantially nonmetallic packer or bridge plug for a downhole tubular, comprising:

a mandrel having an outer surface;

a sealing element;

a plurality of slips movable on at least one cone between a retracted and a set position;

a locking member to hold said slips in said set position with said sealing element compressed against the tubular;

an initial ring structure comprising said slips and holding said slips in relative position;

said slips separate from each other, breaking said ring structure as said slips advance on said cone.

11. The packer or bridge plug of claim 10 wherein:

said cone has a plurality of flats that extend to an end thereof;

each said slip has a flat which rides on the flat of said cone until the slip engages the tubular;

said cone further comprising a guide on each side of each said slip to direct movement of said slip on said flats.

12. The packer or bridge plug of claim 10, wherein:

said initial ring structure comprises breakable nonmetallic tabs between pairs of substantially nonmetallic slips which break as said nonmetallic slips are extended toward the tubular when pushed relative to said cone.

13. The packer or bridge plug of claim 10, wherein:

said locking member comprises a gripping surface which slides with respect to said mandrel in a first direction as said slips are set and said element is compressed, and subsequently penetrates said outer surface of said mandrel to hold said slips in a set position and said element in a compressed position.

14. The packer or bridge plug of claim 13, further comprising:

a nonmetallic anti-extrusion assembly which expands to the tubular to provide full-bore anti-extrusion protection above and below said element.

15. The packer or bridge plug of claim 14, wherein said anti-extrusion assembly further comprises:

a plurality of beveled rings which are designed to be bent toward a flattened position into contact with the tubular upon axial compression.

16. The packer or bridge plug of claim 15, further comprising:

said mandrel comprises an extending segment at at least one end thereof to allow one mandrel of a partially milled or drilled plug or packer to drop and to lock into another mandrel which is still fixed to a tubular in a multiple unit installation so that drilling or milling out of the partially milled plug or packer is facilitated by rotationally locking mandrels.

17. The packer or bridge plug of claim 16, further comprising:

a metallic setting tool to create relative movement to set said slip and compress said element, said setting tool releasable from said mandrel for retrieval while bringing with said setting tool portions thereof severed during the set.

18. In combination, a substantially non-metallic packer or bridge plug for a downhole tubular, comprising:

a mandrel having an outer surface;

a sealing element;

at least one slip movable on at least one cone between a retracted and a set position;

a locking member to hold said slip in said set position with said sealing element compressed against the tubular. a non-metallic anti-extrusion assembly which expands to the tubular to provide full bore anti-extrusion protection above and below said sealing element;

said assembly further comprises:

a plurality of longitudinally slotted rings with offset radial gaps, said rings expand radially when compressed axially.

19. The packer or bridge plug of claim 18, wherein:

said slotted rings are nested so as to allow them to expand together in a radial direction.

20. The packer or bridge plug of claim 19, wherein: said nonmetallic anti-extrusion assembly further comprises a nonsplit beveled ring between said element and said slotted rings.

21. The packer or bridge plug of claim 18, wherein said anti-extrusion assembly further comprises:

a plurality of beveled rings which are designed to be bent toward a flattened position into contact with the tubular upon axial compression.

22. The packer or bridge plug of claim 21, wherein:

said beveled rings comprise a plurality of radial slots to facilitate said bending.

23. The packer or bridge plug of claim 18, wherein:

said rings are held rotationally locked so that there is an offset of radial slots between one ring and the adjacent ring.

24. In combination, a substantially non-metallic packer or bridge plug for a downhole tubular, comprising:

a mandrel having an outer surface;

a sealing element;

at least one slip movable on at least one cone between a retracted and a set position;

a locking member to hold said slip in said set position with said sealing element compressed against the tubular;

a non-metallic anti-extrusion assembly which expands to the tubular to provide full-bore anti-extrusion protection above and below said sealing element;

said anti-extrusion assembly further comprises:

a plurality of beveled rings which are designed to be bent toward a flattened position into contact with the tubular upon axial compression said beveled rings comprise a plurality of radial slots to facilitate said bending; said beveled rings further comprise at least one tab so located so as to rotationally lock one beveled ring to the adjacent ring by extending into the radial slot thereof.

25. In combination, a substantially nonmetallic packer or bridge plug for a downhole tubular, comprising:

a mandrel having an outer surface;

a sealing element;

at least one slip movable on at least one cone between a retracted and a set position;

a locking member to hold said slip in said set position with said sealing element compressed against the tubular; and said mandrel comprises an extending segment on at least one end thereof to allow one mandrel of a partially milled or drilled plug or packer to drop and to lock into another mandrel which is still fixed to a tubular in a multiple unit installation so that drilling or milling out of the partially milled plug or packer is facilitated by rotationally locking mandrels.

26. In combination, a substantially non-metallic packer or bridge plug for a downhole tubular, comprising:

a mandrel having an outer surface;

a sealing element;

at least one slip movable on at least one cone between a retracted and a set position;

a locking member to hold said slip in said set position with said sealing element compressed against the tubular; and a metallic setting tool to create relative movement to set said slip and compress said sealing element, said setting tool releasable from said mandrel for retrieval while bringing with said setting tool portions thereof previously connected to said mandrel and severed during the set.

27. The packer or bridge plug of claim 26, wherein:

said setting tool comprises a tension stud which fails, to complete the set, and a retrieval sleeve which engages the severed portion of said stud which, until failure of said stud, was secured to said mandrel.

* * * * *